US006728979B1

(12) United States Patent
Robert

(10) Patent No.: US 6,728,979 B1
(45) Date of Patent: May 4, 2004

(54) PATIENT TRANSFER DEVICE

(76) Inventor: Byron Robert, 120 Greg Dr., Sunset, LA (US) 70584

( * ) Notice: Subject to any disclaimer, the term of this patent is extended or adjusted under 35 U.S.C. 154(b) by 0 days.

(21) Appl. No.: 10/277,644

(22) Filed: Oct. 22, 2002

(51) Int. Cl.[7] ..... A61G 7/10
(52) U.S. Cl. ..... 5/81.1 R; 5/83.1; 5/81.1 HS
(58) Field of Search ..... 5/81.1 R, 81.1 HS, 5/83.1, 85.1, 88.1

(56) References Cited

U.S. PATENT DOCUMENTS

| | | | | | |
|---|---|---|---|---|---|
| 2,174,434 | A | | 9/1939 | Beaufour | |
| 2,665,432 | A | * | 1/1954 | Butler | 5/88.1 |
| 3,259,922 | A | | 7/1966 | Fischer | |
| 3,403,411 | A | | 10/1968 | Steinemann et al. | |
| 4,372,452 | A | | 2/1983 | McCord | |
| 4,747,170 | A | * | 5/1988 | Knouse | 5/81.1 HS |
| 5,022,810 | A | | 6/1991 | Sherrow et al. | |
| 5,210,887 | A | | 5/1993 | Kershaw | |
| 5,327,592 | A | | 7/1994 | Stump | |
| 5,651,149 | A | * | 7/1997 | Garman | 5/81.1 R |
| 5,697,109 | A | * | 12/1997 | Hodgetts | 5/81.1 R |
| 6,212,712 | B1 | | 4/2001 | Topp | |
| 6,496,991 | B1 | * | 12/2002 | Votel | 5/81.1 HS |

* cited by examiner

*Primary Examiner*—Michael F. Trettel
(74) *Attorney, Agent, or Firm*—Kean, Miller, Hawthorne, D'Armond, McCowan & Jarman LLP

(57) ABSTRACT

A device for transferring medical patients from one table, bed, or gurney to another is disclosed. The device includes a slide board which is slid beneath the patient while the patient is on the gurney. The slide board is then connected to a winch which rests on a cart and can be activated in a controlled manner. The action of the winch pulling the slide board in a horizontal fashion makes the transfer of the patient simple and easy. The cart is designed to be mobile, but includes hooks for fixing the cart to the floor so that it may withstand the stress induced by the retraction of the winch cable.

11 Claims, 4 Drawing Sheets

PATIENT TRANSFER DEVICE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates to an improved device for transferring medical patients, and specifically, to a device comprised of a motorized winch mounted on a support frame that generates a force which to assist medical personnel in transferring patients.

2. Description of Related Art

Non-ambulatory patients are routinely transported throughout hospitals and clinics via gurneys/mobile beds to undergo diagnostic tests and/or surgical procedures. Once the patients are transported to the appropriate location, they often must be transferred from the gurney/mobile bed to a permanent bed or table (e.g. x-ray exam table, imaging exam table, catheter lab table, surgery table, etc.) to undergo treatment or diagnosis. Transferring patients from gurney to table often requires the assistance of multiple medical personnel, especially if the patient is large or overweight. Transferring patients is an especially awkward task because the patient is typically located directly adjacent to the bed or table to which he is being transferred. This arrangement prevents medical personnel from grasping one side of the patient unless they extend themselves across the bed or table. Such actions expose both patients and personnel to the risk of injury. As a result, various devices have been developed and patented to aid the process of transferring patients. These devices generally consist of modified gurneys (that tilt or extend to assist in transferring the patient), overhead or detached-frame cranes (with motorized or manual winch drives that attach to flexible patient-encompassing sheets or pads), or portable slide boards. Further, similar devices have been developed for home use that are designed to transfer disabled patients from bed to wheelchair, etc.

Inventions utilized in the home are typically installed permanently, while those used in the hospitals are generally mobile. Inventions that teach the use of a crane, winch, or other motorized mechanical device require the device to be permanently mounted or installed and typically require the attachment or fitting of some device to the patient. These requirements limit the mobility and utility of such devices by restricting their use to a single location, which increases costs associated with wide-spread facility use. Attaching harnesses and straps to the patient is time consuming and sometimes impractical depending on the patients injuries or infirmities. Further, devices that make use of a winch are usually mounted overhead and thereby make the patient prone to twisting or rotating when they are lifted. Accordingly, additional mechanisms are necessary to reduce these conditions, which increases the complexity and costs of such devices.

Conversely, devices that do not make use of motorized devices typically incorporate hydraulics or make use of Archimedes' lever principle to provide medical personnel the power necessary to safely transfer patients. These mobile devices are usually structurally and mechanically complex, thereby requiring advanced machining and/or production of parts and increased maintenance activities, which increases the costs associated with their adoption. Further, such mobile devices are integrated into the gurney/mobile bed. While such an arrangement offers the advantage of potentially minimizing the number of times patients must be transferred between beds, it also limits the use of the device (and its incorporated transfer apparatus) to a single patient. Accordingly, facility-wide use of such devices requires the purchase of multiple units and the replacement of existing gurneys, which can result in significant expense.

SUMMARY OF THE INVENTION

It is an object of the present invention to provide a device that will assist medical personnel in the transfer of patients from gurney to bed and vice versa.

It is another object of the invention to make the device mobile and accessible in modern hospitals and clinics.

It is another object of the present invention to utilize a mechanical winch, or similar motorized power, to provide the power and force necessary to transfer patients with only one or two medical personnel and with limited physical effort.

It is a further object of the invention to place the motorized power on a height adjustable support frame that can be quickly stabilized for effective operation.

It is another object of the invention to avoid the risks associated with using motorized power for lifting.

It is another object of the invention to provide a patient transfer device of simple design and materials that can be manufactured at a reasonable cost.

It is a further object of the invention to make the device safe and simple to use.

These and other objects, advantages, and features of this invention will be apparent from the following description.

The present invention incorporates the advantages that are inherent to the mobile and permanent devices, while minimizing the disadvantages associated with those general designs. In the preferred embodiment, the device will be independent from existing gurneys and utilize a motorized winch to provide pulling, rather than lifting force. Further, the device is mobile and complements, rather than replaces, the use of existing gurneys, etc. within a facility.

In an alternative embodiment, the winch cable is passed over a pulley attached to the ceiling. Depending on the placement of the pulley relative to the patient and the winch, the force generated will have varying amounts of lifting and pulling components. This potential for variation may be helpful due to the many different qualities of patient which require transfer.

In either case, the winch is fixed in place so that it will resist movement no matter the level of force generated by the winch. The manner of fixing is described below, but it preferably is not permanent, facilitating the use of the device in various places throughout a facility.

DETAILED DESCRIPTION OF THE INVENTION

Figure 1:
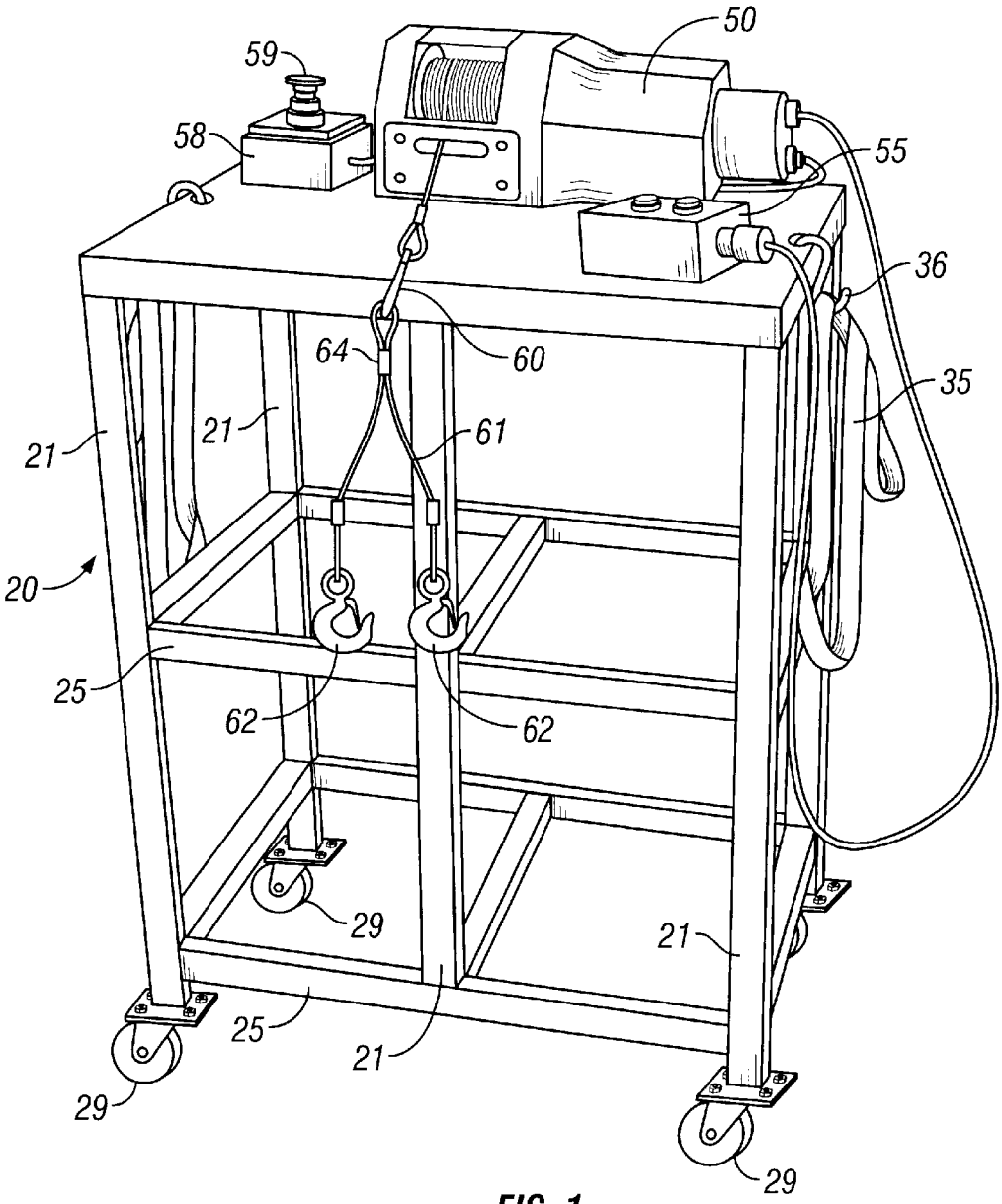
FIG. 1 shows a three-quarters view of a portion of the invention.
Figure 2:
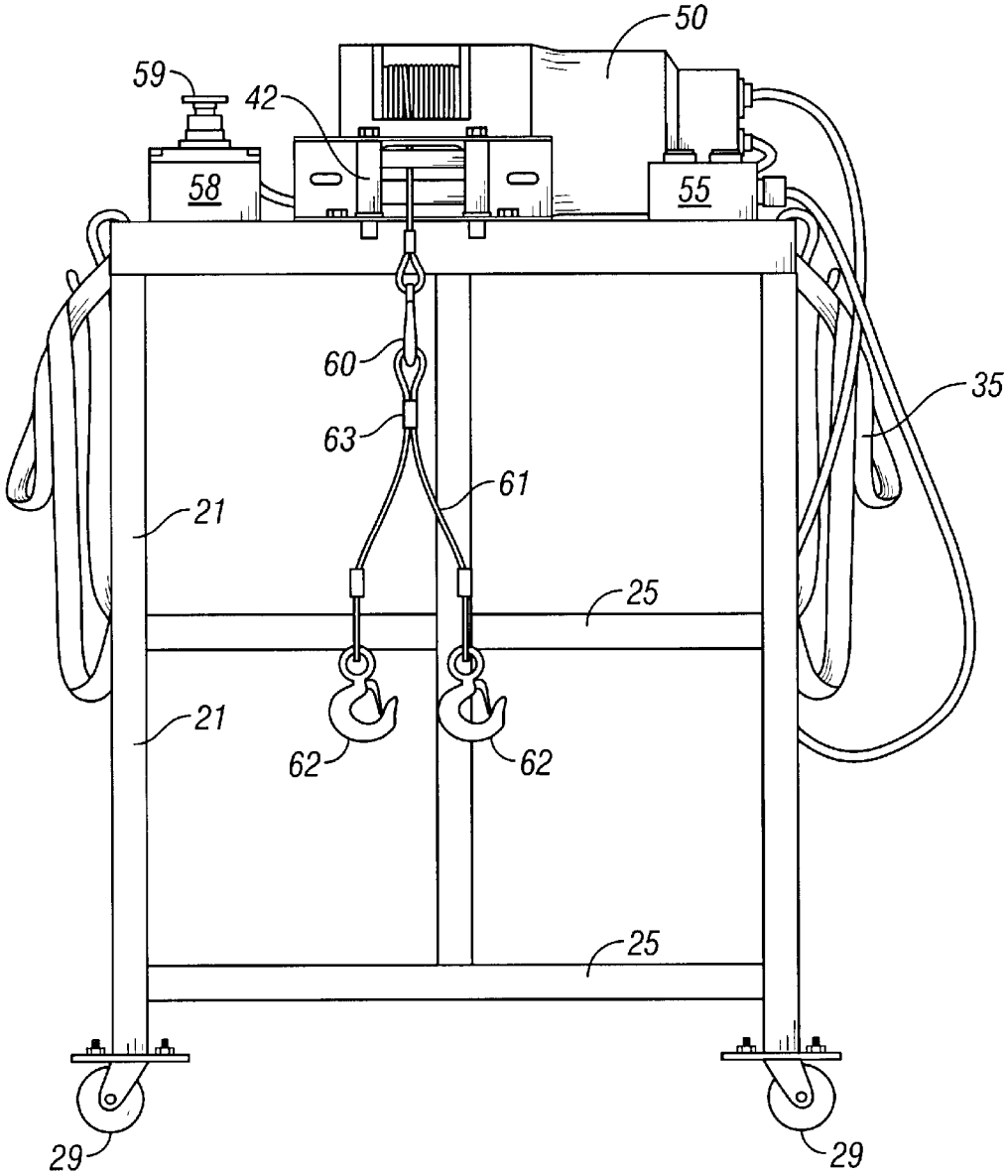
FIG. 2 is a front view of an embodiment of the invention.

FIG. 1 and FIG. 2 depict two views of a representative embodiment of a portion of patient transfer device 10, including winch 50, support frame 20, remote control unit 55, cable 61, and hooks 62. In its preferred form, patient transfer device 10 is utilized in a hospital or clinical environment to transfer patients back and forth between gurneys and stationary examination or operating tables (e.g. x-ray exam table, imaging exam table, catheter lab table, surgery table, etc.).

Figure 3:
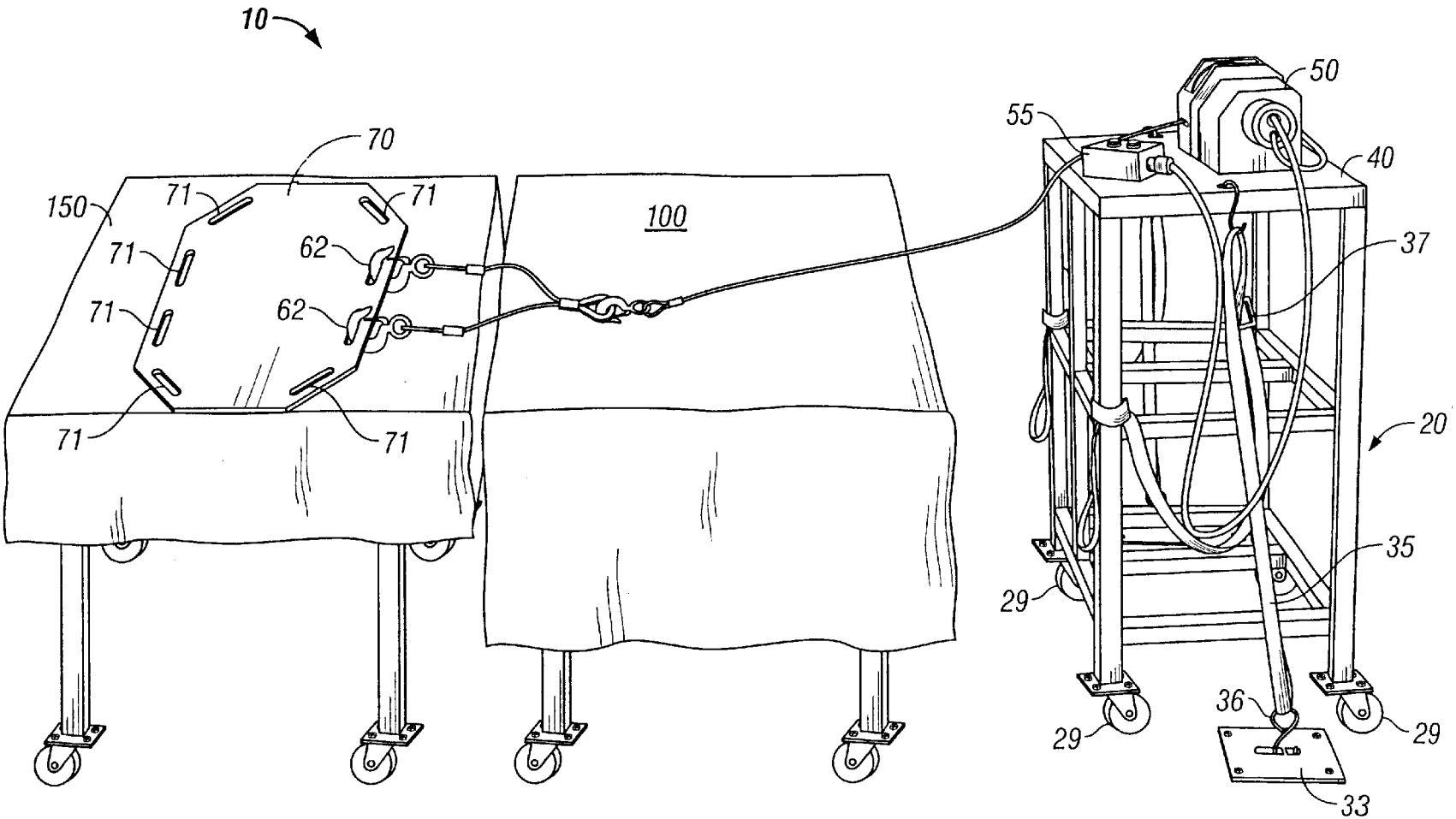
FIG. 3 shows an embodiment of the complete invention as it appears prior to use.

Patient transfer device 10 is shown in its entirety in FIG. 3. The device is generally comprised of winch 50 mounted on support frame 20 that assists medical personnel in transferring patients. The patients are placed on a slide board 70 and pulled from gurney 150 to stationary bed 100 or vice versa.

The device has wheels 29 placed at the bottom of support frame 20 that enable the device to be utilized in multiple positions within a room and in different rooms throughout a facility. Each wheel 29 may include a brake latch to prevent support frame 20 from rolling. In one embodiment, each location where the device is used requires floor anchors 33, which are located approximately two feet apart, to properly secure the patient transfer device from unwanted movement or tipping. The details of floor anchors 33 are illustrated best in FIG. 3.

The desired embodiment makes use of floor anchor 33 on either side of support frame 20 and independent tie-down straps 35. Each tie-down strap 35 contain hooks 36 that attach to the surface plate 40 on the support frame 20 and to the floor anchors 36. The tie-down straps 35 anchor the patient transfer device once the straps are tightened using their respective binders 37. Straps 35 are shown attached to support frame 20 by hooks 36, but any number of means known in the art would suffice.

The desired embodiment allows anchors 33 to remain flush with the floor surface when the device is not in use. This configuration minimizes tripping hazards and maximizes available floor space when the invention is not in the room. Nonetheless, other methods of anchoring the patient transfer device, such as using a female-socket strap that attaches to a male floor anchor, are not intended to be outside the scope of this invention. Differing anchor configurations are also considered in the realm of this invention, such as the use of wall anchors or the addition of anchor weights. Further, in the event that the patient transfer device will be used solely within one room, it might be advantageous to permanently anchor the device onto a wall or floor, which could minimize the area required for the device. A permanent configuration could be accommodated by installing several pulleys (on ceiling and opposite wall) to reverse the pulling motion of winch 50 and allow patients to be transferred back and forth between surfaces.

As indicated, the device transfers patients using winch 50 to pull patients placed on a slide board 70 across the beds. The slide board is of a type typically known in the industry and preferably has multiple lift handles 71 located at its perimeter. The intended use for the lift handles 71 is to allow medical personnel to manually lift and transport patients from bed to table and to allow the attachment of cable 61 to the slide board 70 via two clip hooks 62 that are located at the ends of cable 61. Lift handles 71 may rise above the plane of slide board 70 to help prevent pinching during the movement. Of course, this may make placing slide board 70 beneath the patient more difficult. Therefore, it would be preferable if lift handles 71 could be adjusted to either position.

In one embodiment, cable 61 is a wire rope that is approximately five feet long and is folded at its midpoint over wire thimble 63. Cable 61 is permanently fastened at the base of wire thimble 63 by wire clamp 64. Further, clip hooks 62, which are connected with wire thimble 63, are attached at each end of cable 61 and cable 61 is fastened back to itself with wire clamp 64. The embodiment as described is illustrated in FIG. 3. Alternative embodiments might make use of differing materials such as straps and velcro rather than wire cable and snap hooks. Regardless of the embodiment, the object of cable 61 is to connect winch 50 to slide board 70. In the present embodiment, winch hook 60, which is attached to winch 50, hooks to wire thimble 63 located at the midpoint of cable 61, thereby connecting slide board 70 to winch 50.

Figure 4:
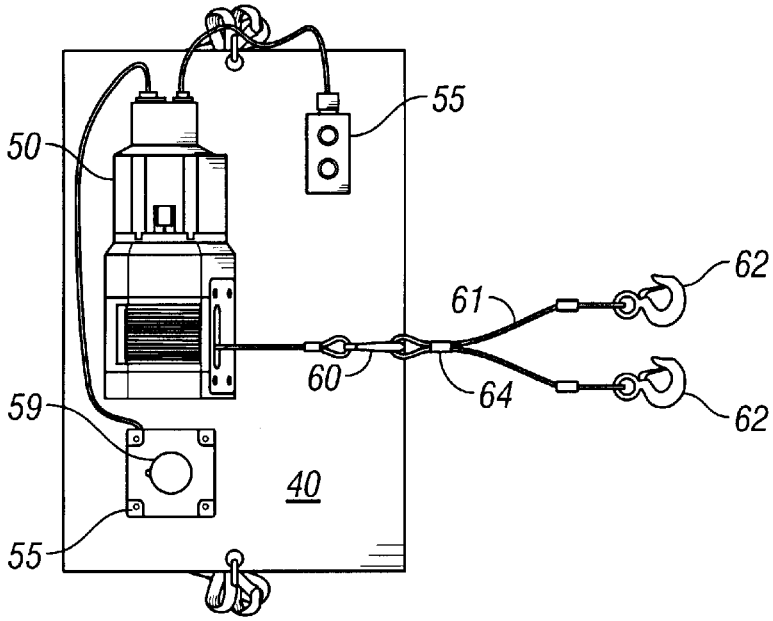
FIG. 4 is a top view of an embodiment of the invention.
Figure 5:
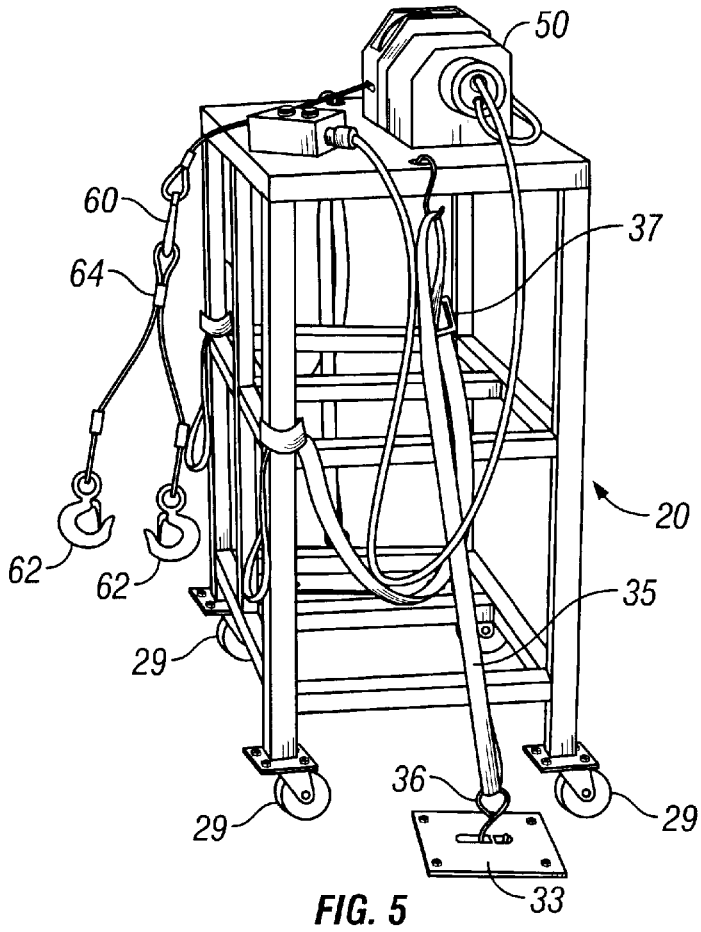
FIG. 5 is a view of an embodiment of the invention as it appears when fixed in place.

Winch 50 is attached to the surface plate 40 and support frame 20 using nuts and bolts of the appropriate size. Surface plate 40 is preferably covered with a rubberized surface to minimize the movement of any items stored on surface plate 20 as the device is transported. Further, fair lead 42 is preferably anchored on the surface plate in front of winch 50, as shown in FIG. 4, to ensure that the motorized winch 50 cable is operated smoothly. As illustrated in FIG. 5, motorized winch 50 is powered by electricity from a standard electrical socket (not shown). Remote control unit 55 is attached to motorized winch 50 via a cable and allows medical personnel to control motorized winch 50 to extend and retract cable 61. Emergency stop button 59 allows medical personnel to immediately interrupt power to the winch whenever necessary and is mounted on surface plate 40. In an alternative embodiment, remote control unit 55 and emergency stop unit 58 might be wireless, which would significantly decrease the amount of wires and clutter associated with the present embodiment.

The patient transfer device uses support frame 20 to support mechanical winch 50 and to withstand forces generated during operation. In the preferred embodiment, support frame 20 is constructed of hollow metal members whereby the longitudinal members 21 and transverse members 25 are welded together in the arrangement illustrated in FIGS. 1, 3 and 5. Nonetheless, any type of material (such as high-density molded plastic or metal alloys) and any known manner of connecting the members (such as mechanical connection or another type of molding) is considered within the scope of this invention. Alternative embodiments might allow for the frame to be height adjustable, thereby allowing medical personnel to optimize the winch height for the type of beds and/or tables that the patient is being moved between. Further, another alternative embodiment might incorporate a portable power supply, such as a battery, into support frame 20 to improve the mobility of the patient transfer device. The following outlines the intended operation of the patient transfer device in its present embodiment.

Initially, the device must be properly anchored. Once patient transfer device 10 is properly positioned, the two tie-down straps 35 are attached to surface plate 40 and floor anchors 33. The patient transfer device is anchored by using binder 37 to tighten the tie-down straps 35. Binder 37 may be in the form of a buckle or any other suitable means for tightening straps 35, such as a friction device or a clamp. Motorized winch 50 is then plugged into a standard wall socket.

A patient on gurney 150 is then moved next to stationary table 100 and placed on top of a slide board 70. Once slide board 70 has been properly placed under the patient on the gurney, medical personnel use remote control unit 55 to extend cable 61. Once sufficient cable has been extended, clip hooks 62 are attached to the proximal and distal ends of lift handles 71 on the side located closest to the patient transfer device. See FIG. 3 for an illustration. The appropriate number of medical personnel (usually one) will then slightly raise one edge of slide board 70 and activate remote control unit 55 to pull the patient to the stationary table 100. Once the patient is in place, clip hooks 62 are disengaged and slide board 70 is removed.

An alternative embodiment of the invention may include a pulley attached to the ceiling. Cable 61 would pass through the pulley prior to being fastened to slide board 70. This pulley would preferably be attached directly above support frame 20 so that a significant horizontal force would remain even as a vertical component to the force of winch 50 was added. This vertical component of force may facilitate the transfer of particularly heavy patients better than a purely horizontal force.

There are of course other alternate embodiments that are obvious from the foregoing descriptions of the invention, which are intended to be included within the scope of the invention, as defined by the following claims.

I claim:

1. A patient transfer device comprising:

a support frame;

a winch attached to said support frame;

a slide board having at least one lift handle;

means for operatively connecting said slide board to said winch; and means for securing said support frame to an immovable object.

2. The patient transfer device of claim 1 wherein said support frame includes means for facilitating the movement of said support frame.

3. The patient transfer device of claim 1, wherein said immovable object is selected from the group consisting of a floor, a wall, or an anchor attached to said floor or said wall.

4. The patient transfer device of claim 2 wherein said means for facilitating the movement of said support frame comprises casters.

5. The patient transfer device of claim 1, wherein said means for securing said support frame to an immovable object comprises:

one or more tie-down straps fixed to said support frame;

a floor anchor, each of said tie-down straps attached to said floor anchor by a hook; and means for tightening said tie-down strap.

6. The patient transfer device of claim 1 wherein said support frame is height-adjustable.

7. The patient transfer device of claim 1 wherein said support frame is immobile.

8. The patient transfer device of claim 1, further comprising an emergency stop mechanism.

9. A method of transferring a patient to a table including the steps of:

providing a support frame;

providing a winch attached to said support frame;

providing a slide board having at least one lift handle;

providing means for operatively connecting said slide board to said winch;

securing said support frame to an immovable object;

aligning said patient and said support frame such that said table is between said patient and said support frame;

placing said patient onto said slide board;

attaching said winch to said slide board;

engaging said winch until said patient rests on said table; and removing said slide board from beneath said patient.

10. The method of claim 9, wherein said immovable object is selected from the group consisting of a floor, a wall, or an anchor attached to said floor or said wall.

11. The method of claim 10 further comprising the step of adjusting the height of said support frame such that said winch is on a level approximately equal to said patient.

* * * * *